US007484571B2

(12) United States Patent
Gaudette et al.

(10) Patent No.: US 7,484,571 B2
(45) Date of Patent: Feb. 3, 2009

(54) DOWNHOLE ABRADING TOOLS HAVING EXCESSIVE WEAR INDICATOR

(75) Inventors: Sean L. Gaudette, Katy, TX (US); Yang Xu, Houston, TX (US); Gerald Lynde, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 245 days.

(21) Appl. No.: 11/480,169

(22) Filed: Jun. 30, 2006

(65) Prior Publication Data

US 2008/0000634 A1 Jan. 3, 2008

(51) Int. Cl.
*E21B 12/02* (2006.01)

(52) U.S. Cl. ..... 175/39

(58) Field of Classification Search ..... 175/39
See application file for complete search history.

(56) References Cited

U.S. PATENT DOCUMENTS

| | | | | |
|---|---|---|---|---|
| 2,422,031 | A * | 6/1947 | Merten | 91/50 |
| 2,457,960 | A * | 1/1949 | Walker | 175/39 |
| 2,461,164 | A * | 2/1949 | Lewis | 175/39 |
| 2,468,905 | A * | 5/1949 | Warren, Jr. | 175/39 |
| 2,560,328 | A * | 7/1951 | Bielstein | 175/39 |
| 2,582,312 | A * | 1/1952 | Del Homme | 175/39 |
| 2,657,909 | A * | 11/1953 | Bielstein | 175/39 |
| 3,011,566 | A | 12/1961 | Graham | |
| 3,062,302 | A | 11/1962 | Toth, et al. | |
| 3,155,176 | A | 11/1964 | Bennett | |
| 3,578,092 | A * | 5/1971 | Tesch et al. | 175/39 |
| 3,678,883 | A | 7/1972 | Fisher | |

(Continued)

FOREIGN PATENT DOCUMENTS

GB 658323 A 10/1951

(Continued)

OTHER PUBLICATIONS

Notification of Transmittal of the International Search Report and the Written Opinion of the International Searching Authority, Or the Declaration, Jan. 8, 2008, pp. 1-2, PCT/US2007/071935, European Patent Office.

(Continued)

*Primary Examiner*—David J Bagnell
*Assistant Examiner*—Cathleen R Hutchins
(74) *Attorney, Agent, or Firm*—Greenberg Traurig LLP; Anthony F. Matheny

(57) ABSTRACT

A downhole abrading tool having a body with a first end for connection to a drill string, a cutting end, a drilling fluid passageway, a restrictor disposed within drilling fluid passageway, and an indicator chamber is disclosed. Upon exposure of the indicator chamber to a well environment due to excessive wear on the cutting end, the restrictor is actuated. Actuation of the restrictor restricts the flow of drilling fluid from the drilling fluid passageway into the well environment. The restriction of flow of drilling fluid from the drilling fluid passageway causes a pressure increase in the drilling fluid flowing through the well that can detected by an operator of the downhole abrading tool. The pressure increase provides an indication to the operator of excessive wear on the cutting end of the downhole abrading tool so that the downhole abrading tool can be removed from the well and replaced.

27 Claims, 6 Drawing Sheets

U.S. PATENT DOCUMENTS

| | | | | | |
|---|---|---|---|---|---|
| 3,714,822 | A | | 2/1973 | Lutz | |
| 3,853,184 | A | * | 12/1974 | McCullough | 175/39 |
| 3,865,736 | A | | 2/1975 | Fries | |
| 4,189,012 | A | | 2/1980 | Garrett | |
| 4,627,276 | A | | 12/1986 | Burgess et al. | |
| 4,655,300 | A | * | 4/1987 | Davis et al. | 175/39 |
| 4,744,242 | A | | 5/1988 | Anderson et al. | |
| 4,785,894 | A | * | 11/1988 | Davis et al. | 175/39 |
| 4,785,895 | A | * | 11/1988 | Davis et al. | 175/39 |
| 4,818,153 | A | | 4/1989 | Strandell et al. | |
| 4,928,521 | A | | 5/1990 | Jardine | |
| 5,202,680 | A | | 4/1993 | Savage | |
| 5,305,836 | A | | 4/1994 | Holbrook et al. | |
| 5,415,030 | A | | 5/1995 | Jogi et al. | |
| 5,442,981 | A | | 8/1995 | Vegh | |
| 5,794,720 | A | | 8/1998 | Smith et al. | |
| 5,979,571 | A | | 11/1999 | Scott et al. | |
| 6,109,368 | A | | 8/2000 | Goldman et al. | |
| 6,131,675 | A | | 10/2000 | Anderson | |
| 6,233,524 | B1 | | 5/2001 | Harrell et al. | |
| 6,408,953 | B1 | | 6/2002 | Goldman et al. | |
| 6,414,905 | B1 | | 7/2002 | Owens et al. | |
| 6,443,228 | B1 | | 9/2002 | Aronstam et al. | |
| 6,484,824 | B2 | | 11/2002 | Skyles | |
| 6,631,772 | B2 | | 10/2003 | Palaschenko | |
| 6,648,082 | B2 | | 11/2003 | Schultz et al. | |
| 6,693,553 | B1 | | 2/2004 | Ciglenec et al. | |
| 6,725,947 | B2 | | 4/2004 | Palaschenko et al. | |
| 6,867,706 | B2 | | 3/2005 | Collette | |
| 6,915,848 | B2 | | 7/2005 | Thomeer et al. | |
| 6,923,273 | B2 | | 8/2005 | Terry et al. | |
| 6,943,697 | B2 | | 9/2005 | Ciglenec et al. | |
| 6,993,432 | B2 | | 1/2006 | Jenkins et al. | |
| 2004/0190374 | A1 | | 9/2004 | Alft et al. | |
| 2005/0267686 | A1 | | 12/2005 | Ward | |
| 2006/0000604 | A1 | | 1/2006 | Jenkins et al. | |
| 2006/0099885 | A1 | | 5/2006 | Lynde et al. | |
| 2007/0209802 | A1 | | 9/2007 | Xu et al. | |

FOREIGN PATENT DOCUMENTS

| | | | |
|---|---|---|---|
| GB | 1276311 | A | 6/1972 |
| WO | WO2005/113926 | A | 12/2005 |

OTHER PUBLICATIONS

International Search Report, Jan. 8, 2008, pp. 1-7, PCT/US2007/071935, European Patent Office.

Written Opinion of the International Searching Authority, Jan. 8, 2008, pp. 1-9, PCT/US2007/071935, European Patent Office.

Office Action dated Feb. 12, 2008 in U.S. Appl. No. 11/479,231, U.S. Patent and Trademark Office.

Office Action dated Feb. 19, 2008 in U.S. Appl. No. 11/479,606, U.S. Patent and Trademark Office.

Office Action dated Feb. 20, 2008 in U.S. Appl. No. 11/496,663, U.S. Patent and Trademark Office.

Notification of Transmittal of the International Search Report and the Written Opinion of the International Searching Authority, Or the Declaration, Nov. 13, 2007, pp. 1-2, PCT/US2007/071926, European Patent Office.

International Search Report, Nov. 13, 2007, pp. 1-3, PCT/US2007/071926, European Patent Office.

Written Opinion of the International Searching Authority, Nov. 13, 2007, pp. 1-5, PCT/US2007/071926, European Patent Office.

* cited by examiner

DOWNHOLE ABRADING TOOLS HAVING EXCESSIVE WEAR INDICATOR

BACKGROUND

1. Field of Invention

The invention is directed to downhole abrading tools utilized in oil and gas wells to abrade objects within the well and, in particular, to downhole mills that are used to abrade, among other objects, stuck tools, bridge plugs, well tubing, and well casing disposed within the well.

2. Description of Art

In the drilling, completion, and workover of oil and gas wells, it is common to perform work downhole in the well bore with a tool which has some sort of wearable working profile interfacing with a downhole structure. Examples would be milling a downhole metal object with a milling tool, performing a washover operation with a rotary shoe, cutting through a tubular with a cutting or milling tool, or drilling through formation with a drill bit. During the performance of these operations, it is common for the working profile of the tool, such as the cutting elements mounted on its lower or outer face, to wear away. As this wear progresses, the effectiveness of the tool decreases.

It is desirable to pull the tool from the well and replace it, when the working profile has experienced a given amount of wear. The degree of wear at which it is desirable to replace the tool depends upon the type of tool and the operation being performed. Unfortunately, it is difficult or even impossible for the well operator at the surface of the well to know accurately when this given amount of wear has occurred. Often, the decision as to when to pull the tool depends substantially upon the experience of the operator. That is, the operator must estimate the amount of tool wear based on whatever is known about the time the operation has been underway, the weight on the tool, the type of downhole structure being worked, the cuttings found in the drilling fluid, or a gradual change in work string torque. None of these parameters provides a definitive indication that the wear in the working profile has progressed to a specific degree at which the operator desires to pull the tool from the well. Pulling a tool prematurely adds unnecessary trips out of the well, adding to rig time and increased costs. Pulling the tool too late gradually decreases the effectiveness of the downhole operation, also adding to rig time and increasing the cost of the operation.

Accordingly, downhole abrading tools and methods of indicating to an operator of a downhole abrading tool of excessive wear on a cutting end of the downhole abrading tool have been desired in the art. As discussed herein, the present downhole abrading tools and methods of indicating to an operator of a downhole abrading tool of excessive wear on the cutting end of a downhole abrading tool effectively and efficiently identify excessive wear on the downhole abrading tool. Therefore, the operator of the downhole abrading tool is informed of when the downhole abrading tool should be removed from the well and replaced.

SUMMARY OF INVENTION

Broadly, the invention is directed to downhole abrading tools utilized in cutting or abrading objects disposed within the well. The term "object" encompasses any physical structure that may be disposed within a well, for example, another tool that is stuck within the well, a bridge plug, the well tubing, or the well casing.

The downhole abrading tools of the invention include a valve disposed within the drilling fluid passageway of the downhole abrading tool. Disposed below the valve, and within the cutting end of the downhole abrading tool is an indicator chamber. The indicator chamber is in fluid communication with the drilling fluid passageway. Initially, the valve permits drilling fluid to flow through the drilling fluid passageway, into outlets, and out of the downhole abrading tool to facilitate abrading of the object. As the downhole abrading tool abrades the object in the well, the cutting end is worn away. Upon excessive wear on the cutting end, the indicator chamber is exposed to the well environment creating a pressure differential between the pressure in the indicator chamber and the well environment. As a result of this pressure differential, the valve is actuated such that the flow of the drilling fluid through the outlets from the drilling fluid passageway is restricted. Due to the decrease in volume of drilling fluid flowing through the downhole abrading tool, the pressure of the drilling fluid, being monitored by the operator at the surface, noticeably increases to indicate to the operator that the downhole abrading tool has experienced excessive wear and should be replaced.

In accordance with the invention, the foregoing advantages have been achieved through the present downhole abrading tool. The downhole abrading comprises a body for connection to a drill string and having a drilling fluid passageway therethrough with an outlet for the passage of a drilling fluid having a drilling fluid pressure; a cutting end on the body for rotation against an object in the well; a chamber having a wear-away portion that is recessed within the cutting end, the wear-away portion wearing away and exposing the chamber to a wellbore pressure when the cutting end wears a selected amount; and a movable restrictor in fluid communication with the chamber and the drilling fluid passageway, for movement from a first position to a second position, creating a pressure increase in the drilling fluid passageway when the chamber is exposed to the wellbore pressure.

A further feature of the downhole abrading tool is that the restrictor may comprise a piston slidably carried within the drilling fluid passageway. Another feature of the downhole abrading tool is that the restrictor may comprise a differential area piston. An additional feature of the downhole abrading tool is that the restrictor may comprise a piston having a first pressure area in fluid communication with the chamber; and a second pressure area in fluid communication with the drilling fluid passageway, the first pressure area being greater than the second pressure area. Still another feature of the downhole abrading tool is that while in the second position, the restrictor may block at least a portion of the drilling fluid flowing through the outlet. A further feature of the downhole abrading tool is that the outlet may intersect the drilling fluid passageway at a port and, while in the first position, the restrictor is spaced below the port in the drilling fluid passageway and in the second position the restrictor at least partially blocks the port. Another feature of the downhole abrading tool is that the restrictor may comprise a movable piston that moves axially when the wear-away portion wears away and the chamber is exposed to the wellbore pressure, the movable piston having a closed first side exposed to atmospheric pressure in the chamber and a bore containing a fixed piston, the bore defining an annular second side exposed to the drilling fluid pressure in the drilling fluid passageway, so that when the first side is exposed to wellbore pressure via the chamber, the movable piston slides upward relative to the fixed piston to the second position. An additional feature of the downhole abrading tool is that the downhole tool may further comprise a rod extending downward from the fixed piston sealingly through closed first side of movable piston, the rod being stationary carried by the body. Still another feature of the downhole abrading tool is that the fixed piston may limit movement of the movable piston to the second position. A further feature of the downhole abrading tool is that the wear away portion may include at least one taggant that is releasable from the cutting end as the wear away portion is worn away. Another feature of the downhole abrading tool is that the taggant may be selected from the group consisting of a radio-frequency tag, a colored dye, a radioactive material, a florescent material, a pellet, each of the at least one pellets having an outer shell encasing a core, the outer shell being dissolvable in the drilling fluid and the core being an expandable material, and mixtures thereof. An additional feature of the downhole abrading tool is that the downhole abrading tool further may further comprise a partition disposed within the drilling fluid passageway; a sleeve disposed on an exterior surface of the body, the sleeve and the body defining an annular cavity, the restrictor being a piston disposed within the cavity, the chamber being in fluid communication with a lower end of the piston; an upper port in the body above the partition leading to leading from the drilling fluid passageway to the cavity; and a lower port in the body below the partition leading from the drilling fluid passageway to the cavity, wherein, while in the first position, the piston allows unrestricted flow of drilling fluid from the drilling fluid passageway, through the upper port and the lower port to the outlet and, in the second position, the piston at least partially blocks the lower port.

In accordance with the invention, the foregoing advantages also have been achieved through a downhole abrading tool for rotatably abrading an object in a well in which the well has a surface location and a downhole location. In this embodiment, the downhole abrading tool comprises a body having a first end, a cutting end, and a drilling fluid passageway extending through the body and having an outlet for discharging a drilling fluid having a drilling fluid pressure, the first end adapted for being connected to a portion of a string for rotation, and the cutting end containing an abrading material for rotatably engaging the object in the well; a differential area piston assembly having a first pressure area in fluid communication with the drilling fluid passageway and a second pressure area that is larger than the first pressure area; and a chamber adjacent the cutting end and in fluid communication with the second pressure area of the differential area piston assembly, such that when the chamber becomes in fluid communication with a wellbore pressure due to wear of the abrading material, the wellbore pressure acts on the second pressure area to cause the differential area piston assembly to move to a position at least partially restricting the flow of drilling fluid, providing a pressure increase indication at the surface location.

A further feature of the downhole abrading tool is that the differential area piston assembly may be carried within the drilling fluid passageway. Another feature of the downhole abrading tool is that the outlet may intersect the drilling fluid passageway at a port and wherein the differential area piston assembly may at least partially block the port when the chamber becomes exposed to wellbore pressure. An additional feature of the downhole abrading tool is that the differential area piston assembly may comprise a movable piston having a closed lower end that defines the second pressure area, a bore, and a fixed piston sealingly carried in the bore and secured stationary to the body, wherein the first pressure area comprises an annular upper end surrounding the bore. Still another feature of the downhole abrading tool is that the downhole abrading tool may further comprise a plug in a lower end of the drilling fluid passageway; and a rod secured to the fixed piston extending sealingly through the closed lower end of the movable piston and secured to the plug. A further feature of the downhole abrading tool is that the abrading material may include at least one taggant that is releasable from the cutting end as the abrading material is worn away.

In accordance with the invention, the foregoing advantages also have been achieved through the present method of indicating wear of a downhole abrading tool. The method comprises the steps of: (a) providing a chamber with a wear-away portion that is recessed within the cutting end; (b) providing a restrictor in fluid communication with the chamber and the drilling fluid passageway; (c) during operation, causing the wear-away portion to wear away and expose the chamber to a wellbore pressure; then (d) causing the restrictor to move in response to the wellbore pressure to a position at least partially restricting the flow of drilling fluid through the drilling fluid passageway to cause an increase in the drilling fluid pressure.

A further feature of the method of indicating wear of a downhole abrading tool is that step (b) may comprise applying drilling fluid pressure to a first pressure area of the restrictor and step (d) may comprise applying wellbore pressure to a second pressure area of the restrictor, the second pressure area being greater than the first pressure area. Another feature of the method of indicating wear of a downhole abrading tool is that the restrictor may be slidably carried within the drilling fluid passageway, and step (d) may comprise moving the restrictor to a position at least partially blocking passage of drilling fluid from the drilling fluid passageway through the outlet.

The downhole abrading tools and methods of indicating to an operator of a downhole abrading tool of excessive wear on a cutting end of the downhole abrading tool have the advantages of providing effective and efficient identification of excessive wear on the downhole abrading tool.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
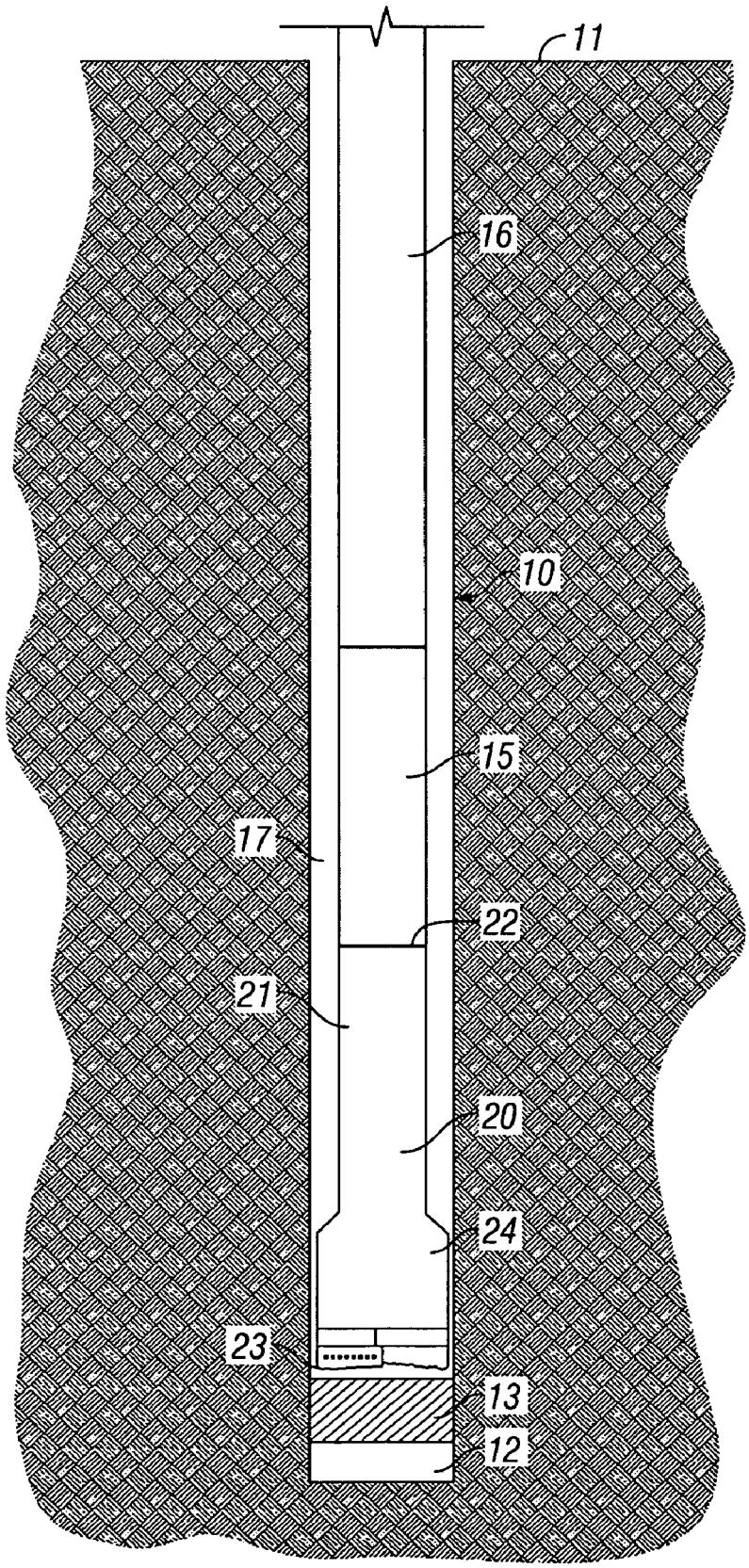
FIG. 1 is a cross-sectional view of a specific embodiment of a downhole abrading tool of the present invention shown disposed in a well.

Referring to FIG. 1, oil and gas wells 10 have surface location 11 and downhole location 12. Object 13 is disposed within well 10. Downhole abrading tool 20 is connected to rotating component 15 which, together with downhole abrading tool 20, is part of drill string 16. Downhole abrading tool 20 is placed in contact with object 13 and then rotated, using equipment known to persons skilled in the art, to abrade object 13.

As shown in FIGS. 1-5, downhole abrading tool 20 includes body 21, having first end 22, cutting end 23, head 24, and drilling fluid passageway 26. First end 22 is adapted to be connected to rotating component 15 or drill string 16 to facilitate rotation of downhole abrading tool 20. First end 22 preferably includes threads (not shown) to facilitate attachment to rotating component 15 or drill string 16.

Drilling fluid passageway 26 is disposed longitudinally within body 20 to permit drilling fluid to flow through downhole abrading tool 20. Accordingly, drilling fluid (not shown) flows from equipment (not shown) located at surface location 11, through drill string 16, through drilling fluid passageway 26, and through at least one outlet 28 into well environment 17. Outlets 28 are inclined relative to drilling fluid passageway 26 and intersect drilling fluid passageway 26 at ports 29 disposed within the wall of drilling fluid passageway 26. Each outlet 28 may have a nozzle (not shown).

The drilling fluid facilitates cutting by downhole abrading tool 20. Drilling fluid flows from surface location 11, through drilling fluid passageway 26, through outlet 28 into well environment 17 at a drilling fluid pressure that is monitored by an operator of downhole abrading tool 20.

Cutting end 23 includes abrading matrix 18 formed of an abrading material, such as hardfacing or other cutting or abrading material known in the art. The abrading material may be formed, in whole or in part, from a wear away portion that wears from cutting end 23 during abrasion of object 13. Such abrading materials are known in the art.

Disposed within abrading matrix 18 is indicator or wear-away chamber 19, which is in fluid communication with drilling fluid passageway 26. Indicator chamber 19 is initially sealed from the drilling fluid in the wellbore as well as the drilling fluid being pumped down drilling fluid passageway 26. The initial pressure in indicator chamber 19 may be atmospheric. A specifically designed wear away portion may be disposed within cutting end 23 and over indicator chamber 19 which is recessed within cutting end 23. Alternatively, the entire abrading matrix 18 may be formed from an abrading material that functions as the wear away portion. Indicator chamber 19 extends perpendicular to the axis of downhole abrading tool 20 at least part way across cutting end 23.

Plug 36 is secured into the lower end of drilling fluid passageway 26, such as by a retainer ring, threads, or welding. A communication passage 37 extends from indicator chamber 19 vertically through plug 36. Valve or movable piston 30 is disposed within drilling fluid passageway 26 above plug 36. Movable piston 30 is a hollow cylindrical member with bore 30*b*. Fixed piston 32 is disposed within closed bottom 30*a* and bore 30*b*, defining an annular upper end 30*c*. Movable piston 30 is a differential piston with a greater pressure area at closed bottom 30*a* than at upper end 30*c*.

Figure 2:
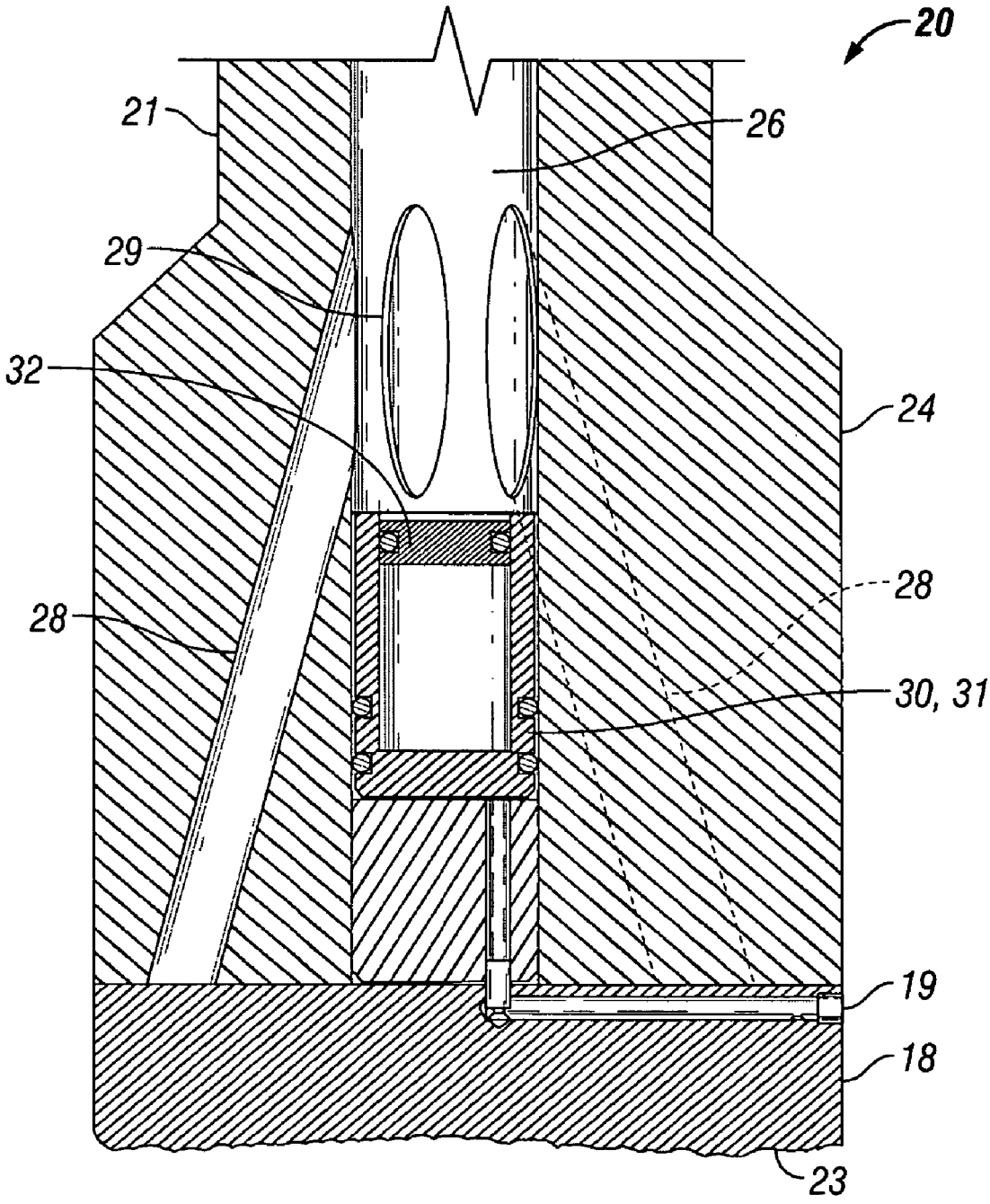
FIG. 2 is a cross-sectional view of the head of a specific embodiment of a downhole abrading tool of the present invention during normal milling operations.

As shown in FIG. 2, in one embodiment, fixed piston 32 may be secured to the inner wall of drilling fluid passageway 26 to prevent movement of fixed piston 32 relative to head 24. A portion of upper end 30*c* is permitted move past fixed piston 32; however, the remaining portion of upper end 30*c* is restricted from upward movement past fixed piston 32.

Figure 3:
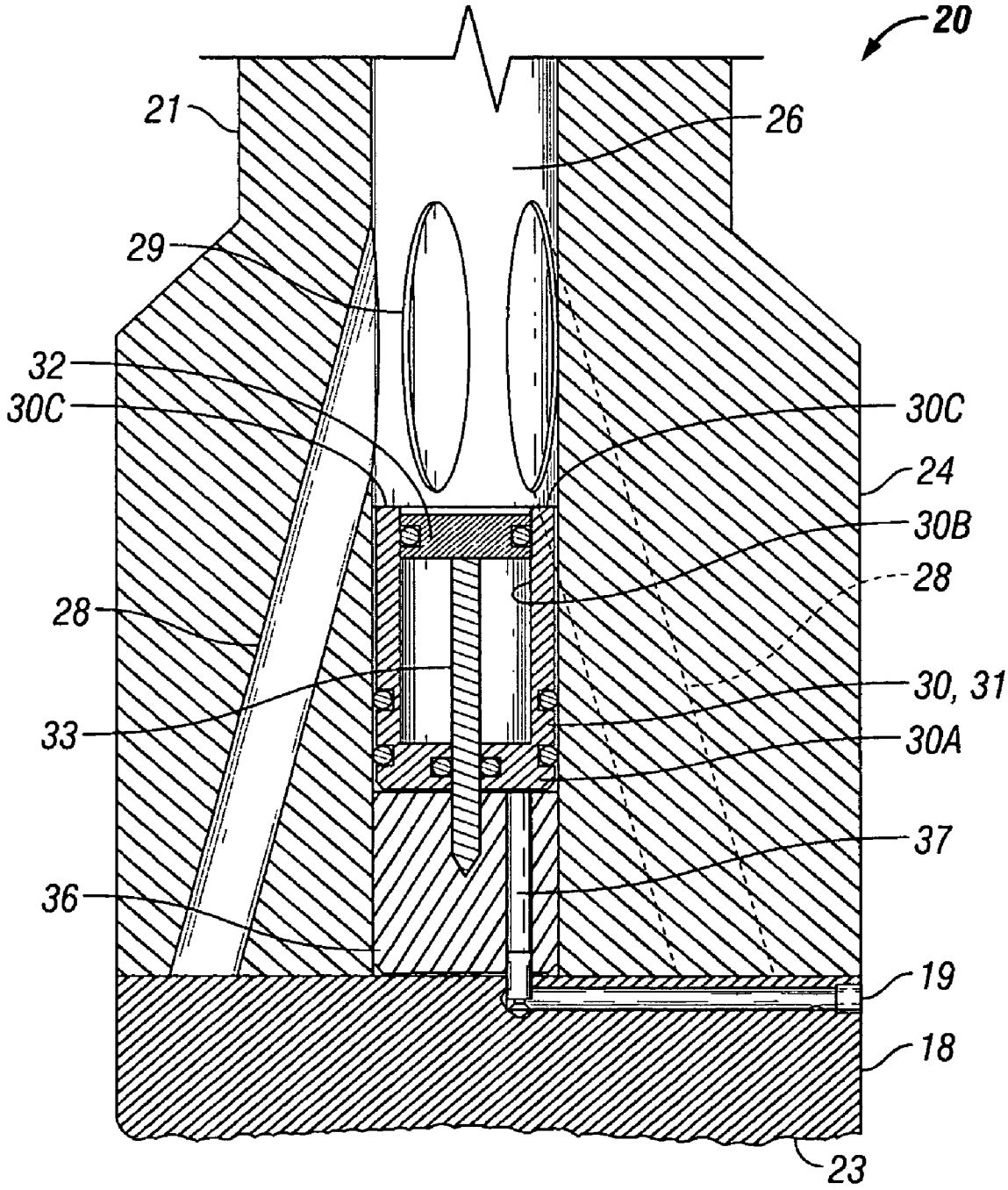
FIG. 3 is a cross-sectional view of the head of another specific embodiment of a downhole abrading tool of the present invention in which drilling fluid is not restricted from flowing from the drilling fluid passageway and through the outlets into the well environment.
Figure 4:
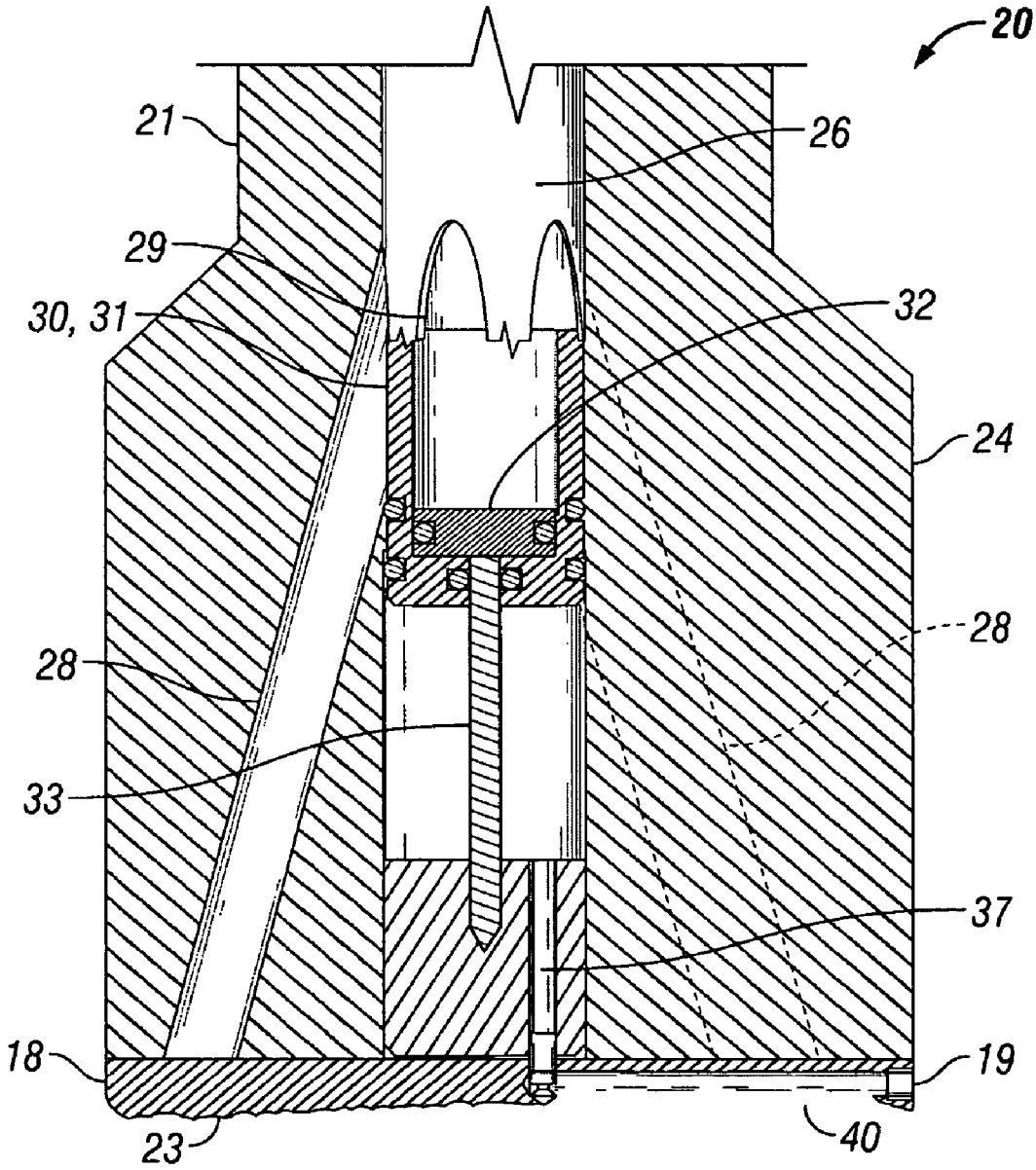
FIG. 4 is a cross-sectional view of the head of the embodiment of the downhole abrading tool shown in FIG. 3 after excessive wear has occurred.

Alternatively, as illustrated in FIGS. 3-4, fixed piston 32 is secured by rod 33 to plug 36 to prevent movement of fixed piston 32 relative to head 24. Rod 33 extends sealingly through a hole in closed bottom 30*a*. Fixed piston 32 also limits the upper travel of movable piston 30 to the position shown in FIG. 4. the location where indicator chamber 19 is in fluid communication with drilling fluid passageway is valve 30. As shown in FIGS. 2-5, valve 30 is piston 31. Piston stop 32 is also disposed within drilling fluid passageway 26. Piston stop 32 limits the movement of piston 31 within drilling fluid passageway 26. Piston stop is preferably disposed within drilling fluid passageway 26 such that outlet ports 29 are partially blocked.

During operation, drilling fluid flows through outlets 28. The drilling fluid pressure exerts a downward force on movable piston 30, and more particularly, on upper end 30*c*. There is no upward force component initially on piston 30 because the pressure in indicator chamber 19 and passage 37 is atmospheric.

As illustrated in FIG. 4, when cutting end 23 experiences excessive wear 40, indicator chamber 19 is exposed to well environment 17. In other words, excessive wear 40 results in the wear away portion being worn off of cutting end 23. Alternatively, excessive wear 40 results in the abrading material being worn off of cutting end 23. When indicator chamber 19 is exposed to well environment 17 and, thus, to the wellbore pressure, the pressure in indicator chamber 19 increases from atmospheric to wellbore pressure. The wellbore pressure acts on bottom end 30*a* of movable piston 30 while the drilling fluid pressure in drilling fluid passageway 26 exerts a downward force on piston 30. The wellbore pressure is less than the drilling fluid pressure because of the pressure drop through outlets 28. However, the pressure area on bottom end 30*a* is greater than the pressure area of upper end 30*c*. As a result, piston 30 moves from a first position upward within drilling fluid passageway 26 to a second position partially obstructing ports 29. In the second position, the drilling fluid flowing from drilling fluid passageway 26, through outlet ports 29, and through outlets 28 is restricted.

As mentioned above, preferably, the drilling fluid flowing from drilling fluid passageway 26, through ports 29, and outlets 28 is partially restricted such that drilling fluid is still permitted to flow through outlet ports 29 and outlets 28 into the well environment. However, it is to be understood that the flow of the drilling fluid from drilling fluid passageway 26, through outlet ports 29, and through outlets 28 may be blocked completely.

Due to the restriction of the flow of drilling fluid through drilling fluid passageway 26, the pressure of drilling fluid, being monitored by the operator at the surface, noticeably increases to indicate to the operator that downhole abrading tool 20 has experienced excessive wear and should be replaced.

Figure 5:
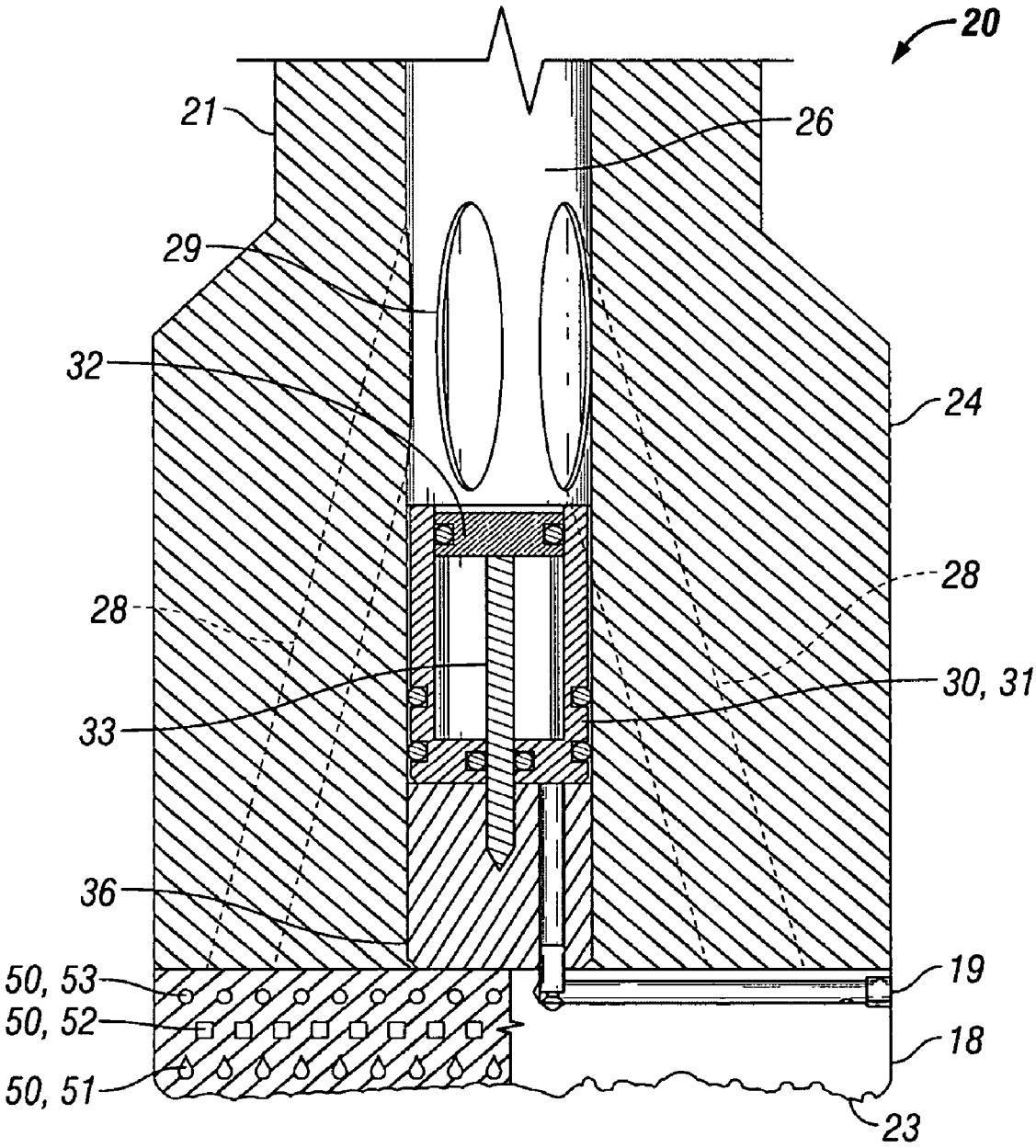
FIG. 5 is a partial cross-sectional view of the head of an additional specific embodiment of a downhole abrading tool of the present invention.

In another embodiment shown in FIG. 5, downhole abrading tool 20 is designed and operates in the same manner discussed above with respect to the embodiment shown in FIGS. 1-4. In this specific embodiment, however, downhole abrading tool 20 further includes taggants 50 embedded or disposed within abrading matrix 18. Each taggant 50 may be, for example, a colored dye, a radio-frequency tag, a radioactive material, a florescent material, or a pellet having an outer shell that is dissolvable in the drilling fluid and that encases a core formed of an expandable material such as styrofoam. As abrading matrix 18 is worn away due to excessive wear on cutting end 23 of downhole abrading tool 20, one or more taggant 50 is released from abrading matrix 18 into well environment 17 and, thus, into the drilling fluid. As the drilling fluid circulates up well 10 in well environment 17 to surface location 11, it carries with it each of the released taggants 50. Upon reaching surface location 11, taggants 50 are detected by the operator of the downhole abrading tool 20, either visually, or using equipment designed specifically for the detection of taggant 50. Identification of taggants 50 by the operator provides an indication that downhole abrading tool 20 has experienced excessive wear. Alternatively, the identification of taggants 50 can indicate to the operator that cutting end 23 is approaching the point at which cutting end 23 experiences excessive wear.

In one specific embodiment, taggants 50 are formed integral with the abrading material that forms abrading matrix 18. In other words, in this embodiment, taggants 50 are embedded or disposed within abrading matrix 18 during the formation of abrading matrix 18.

As shown in FIG. 5, different taggants 50 are disposed at different locations within abrading matrix 18, thereby providing different indications as to the extent of wear on cutting end 23. For example, taggants 51 are released prior to taggants 52 and taggants 52 are released prior to taggants 53. Accordingly, the operator is provided with incremental indication as to the wear on cutting end 23. Alternatively, taggants 51, 52, and 53 can be disposed in specific areas of abrading matrix 18, e.g., taggants 51 on the sides, taggants 52 on the bottom, and taggants 53 in the middle so that an indication can be made as to the specific area or region of cutting end 23 undergoing wear.

Various combinations of the different types of taggants 50 can be used to better educate the operator as to the location of the excessive wear on cutting end 23 as well as the degree of wear occurring at various locations of cutting end 23. For example, taggants 50 having colored dyes may be released if excessive wear occurs on the outer portions of abrading matrix 18 and taggants 50 having radio-frequency tags may be released if excessive wear occurs on the center portion of abrading matrix 18.

Figure 6:
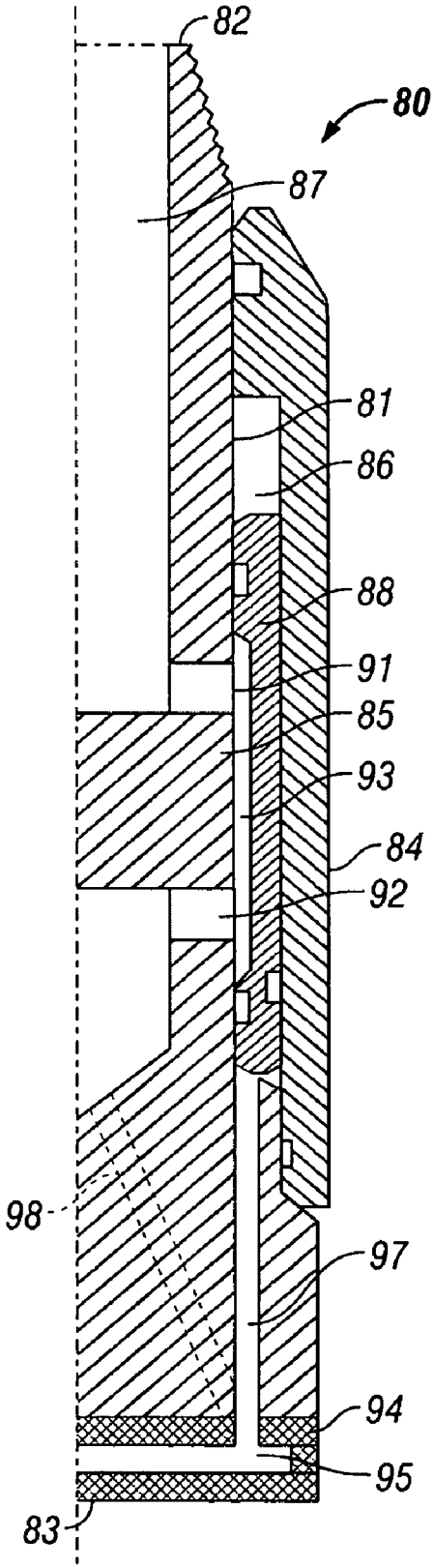
FIG. 6 is a cross-sectional view of another specific embodiment of a downhole abrading tool of the present invention in which drilling fluid is not restricted from flowing from the drilling fluid passageway and through the outlets into the well environment.
Figure 7:
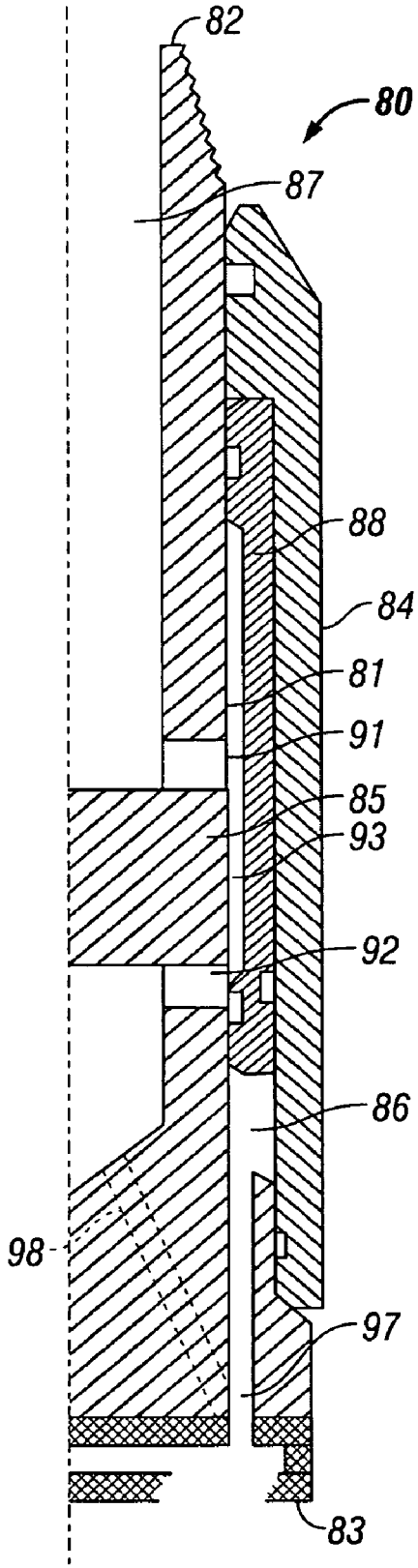
FIG. 7 is a cross-sectional view of the embodiment of the downhole abrading tool shown in FIG. 6 after excessive wear has occurred.

Referring now to FIGS. 6-7, in another specific embodiment, downhole abrading tool 80 includes exterior surface 81, first end 82, second end 83, chamber sleeve 84, and drilling fluid passageway 87 having partition 85 disposed therein. Chamber sleeve 84 includes chamber cavity 86 having disposed therein valve or movable piston 88. The exterior of piston 88 seals against chamber sleeve 84 and the interior of piston 88 seals against exterior surface 81. Downhole abrading tool 80 also includes drilling fluid passageway 87 having upper port 91 and lower port 92 disposed within the body of downhole abrading tool 80. Upper port 91 is above partition 85 and lower port 92 id below partition 85. Upper port 91 and lower port 92 are in fluid communication with each other by piston passageway 93 or recess in the inner diameter of piston 88 between its upper and lower seals.

Downhole abrading tool 80 also includes outlet 98 (shown in dashed lines) below partition 85 providing fluid communication between drilling fluid passageway 87 and the well environment.

Partition 85 requires all of the drilling fluid to flow through upper port 91, passageway 93, and lower port 92 as it flows to outlet 98.

Cutting end 83 includes abrading matrix 94 formed of an abrading material, such as hardfacing or other cutting or abrading material known in the art. The abrading material may be formed, in whole or in part, from a wear away portion that wears from cutting end 83 during abrasion of an object disposed within the well (such as object 13 discussed in greater detail above). Such abrading materials are known in the art.

Disposed within abrading matrix 94 is indicator or wear-away chamber 95, which is in fluid communication with chamber cavity 86 below piston 88. Indicator chamber 95 is initially sealed from the drilling fluid in the wellbore as well as the drilling fluid being pumped down drilling fluid passageway 87. The initial pressure in indicator chamber 95 may be atmospheric. A specifically designed wear away portion may be disposed within cutting end 83 and over indicator chamber 95 which is recessed within cutting end 83. Alternatively, the entire abrading matrix 94 may be formed from an abrading material that functions as the wear away portion. Indicator chamber 95 extends perpendicular to the axis of downhole abrading tool 80 at least part way across cutting end 83. A communication passage 97 extends from indicator chamber 95 vertically to chamber cavity 86.

During operation, drilling fluid flows through drilling fluid passageway 87, through upper port 91, through piston passageway 93, through lower port 92 into drilling fluid passageway 87, through outlet 98 and into the well environment. There is no upward force component initially on piston 88 because the pressure in indicator chamber 95 and passage 97 is atmospheric. The forces acting on piston 88 due to the drilling fluid flowing through upper port 91 and lower port 92 are balanced. There is no pressure other than atmospheric pressure in chamber 86 above the upper seal of piston 88, nor below the lower seal of piston 88.

As illustrated in FIG. 7, when cutting end 83 experiences excessive wear, indicator chamber 95 is exposed to well environment 17 (FIG. 1). In other words, the excessive wear results in the wear away portion being worn off of cutting end 83. Alternatively, the excessive wear results in the abrading material being worn off of cutting end 83. When indicator chamber 95 is exposed to well environment 17 and, thus, to the wellbore pressure, the pressure in indicator chamber 95 increases from atmospheric to wellbore pressure. The wellbore pressure acts on the bottom end of piston 88 in an upward direction. The pressure area on the bottom end of piston 88 is greater than the pressure above piston 88, which is atmospheric. As a result, piston 88 moves from a first position upward within chamber cavity 86 to a second position at least partially obstructing lower port 92. In the second position, the drilling fluid flowing from drilling fluid passageway 87, through upper port 91, through piston passageway 93, and through lower port 92 is restricted.

However, preferably, the drilling fluid flowing from drilling fluid passageway 87, through upper port 91, through piston passageway 93, and through lower port 92 is only partially restricted such that drilling fluid is still permitted to flow through upper port 91, piston passageway 93, lower port 92 and, thus, ultimately outlet 98 into the well environment. To prevent full blockage, the upper end of chamber 86 may located so that piston 88 contacts it when in its upper most position, shown in FIG. 7. However, it is to be understood that the flow of the drilling fluid from drilling fluid passageway 87, through upper port 91, piston passageway 93, and lower port 92 may be blocked completely by allowing piston 88 to move further upward.

Due to the restriction of the flow of drilling fluid through drilling fluid passageway 87, through upper port 91, through piston passageway 93, and through lower port 92, the pressure of drilling fluid, being monitored by the operator at the surface, noticeably increases to indicate to the operator that downhole abrading tool 80 has experienced excessive wear and should be replaced.

It is to be understood that the invention is not limited to the exact details of construction, operation, exact materials, or embodiments shown and described, as modifications and equivalents will be apparent to one skilled in the art. For example, other arrangements for a differential area piston are feasible such as an arrangement in which the upper end could be of a smaller outer diameter than the bottom end. Accordingly, the invention is therefore to be limited only by the scope of the appended claims.

What is claimed is:

1. A downhole abrading tool for rotatably abrading an object in a well, the downhole abrading tool comprising:

a body for connection to a drill string and having a drilling fluid passageway therethrough with an outlet for the passage of a drilling fluid having a drilling fluid pressure;

a cutting end on the body for rotation against an object in the well;

a chamber having a wear-away portion that is recessed within the cuffing end, the wear-away portion wearing away and exposing the chamber to a wellbore pressure when the cutting end wears a selected amount; and a movable restrictor in fluid communication with the chamber and the drilling fluid passageway and slidably carried within the drilling fluid passageway; for sliding movement along an inner wall surface of the drilling fluid passageway from a first position to a second position, the second position defined by a portion of the movable restrictor sliding along the inner wall surface of the drilling fluid passageway to at least partially block the outlet to create a pressure increase in the drilling fluid passageway when the chamber is exposed to the wellbore pressure.

2. The downhole abrading tool of claim 1, wherein the restrictor comprises a piston.

3. The downhole abrading tool of claim 1, wherein the restrictor comprises a differential area piston.

4. The downhole abrading tool of claim 1, wherein the restrictor comprises:

a piston having a first pressure area in fluid communication with the chamber; and a second pressure area in fluid communication with the drilling fluid passageway, the first pressure area being greater than the second pressure area.

5. The downhole abrading tool of claim 1, wherein, while in the second position, the restrictor blocks at least a portion of the drilling fluid flowing through the outlet.

6. The downhole abrading tool of claim 1, wherein the outlet intersects the drilling fluid passageway at a port and while in the first position, the restrictor is spaced below the port in the drilling fluid passageway and in the second position the restrictor at least partially blocks the port.

7. The downhole abrading tool of claim 1, wherein the restrictor comprises:

a movable piston that moves axially when the wear-away portion wears away and the chamber is exposed to the wellbore pressure, the movable piston having a closed first side exposed to an atmospheric pressure in the chamber and a bore containing a fixed piston, the bore defining an annular second side exposed to the drilling fluid pressure in the drilling fluid passageway, so that when the first side is exposed to wellbore pressure via the chamber, the movable piston slides upward relative to the fixed piston to the second position.

8. The downhole abrading tool of claim 7, wherein the downhole tool further comprises a rod extending downward from the fixed piston sealingly through closed first side of movable piston, the rod being stationary carried by the body.

9. The downhole abrading tool of claim 7, wherein the fixed piston limits movement of the movable piston to the second position.

10. The downhole abrading tool of claim 1, wherein the wear away portion includes at least one taggant that is releasable from the cutting end as the wear away portion is worn away.

11. The downhole abrading tool of claim 10, wherein the taggant is selected from the group consisting of a radio-frequency tag, a colored dye, a radioactive material, a florescent material, a pellet, each of the at least one pellets having an outer shell encasing a core, the outer shell being dissolvable in the drilling fluid and the core being an expandable material, and mixtures thereof.

12. A downhole abrading tool for rotatably abrading an object in a well, the well having a surface location and a downhole location, the downhole abrading tool comprising:

a body having a first end, a cutting end, and a drilling fluid passageway extending through the body and having an outlet for discharging a drilling fluid having a drilling fluid pressure, the first end adapted for being connected to a portion of a string for rotation, and the cutting end containing an abrading material for rotatably engaging the object in the well;

a differential area piston assembly having a first pressure area in fluid communication with the drilling fluid passageway and a second pressure area that is larger than the first pressure area; and a chamber adjacent the cutting end and in fluid communication with the second pressure area of the differential area piston assembly, such that when the chamber becomes in fluid communication with a wellbore pressure due to wear of the abrading material, the wellbore pressure acts on the second pressure area to cause the differential area piston assembly to move to a position at least partially restricting the flow of drilling fluid, providing a pressure increase indication at the surface location.

13. The downhole abrading tool of claim 12, wherein the differential area piston assembly is carried within the drilling fluid passageway.

14. The downhole abrading tool of claim 12, wherein the outlet intersects the drilling fluid passageway at a port and wherein the differential area piston assembly at least partially blocks the port when the chamber becomes exposed to wellbore pressure.

15. The downhole abrading tool of claim 12, wherein the differential area piston assembly comprises:

a movable piston having a closed lower end that defines the second pressure area, a bore, and a fixed piston sealingly carried in the bore and secured stationary to the body, wherein the first pressure area comprises an annular upper end surrounding the bore.

16. The downhole abrading tool of claim 15, wherein the downhole abrading tool further comprises:

a plug in a lower end of the drilling fluid passageway; and a rod secured to the fixed piston extending sealingly through the closed lower end of the movable piston and secured to the plug.

17. The downhole abrading tool of claim 12, wherein the abrading material includes at least one taggant that is releasable from the cutting end as the abrading material is worn away.

18. A method of indicating wear of a downhole abrading tool having a body for connection to a drill string and having a drilling fluid passageway therethrough having an outlet for the passage of a drilling fluid having a drilling fluid pressure, and a cutting end on the body for rotation against an object in the well, the method comprising the steps of:

(a) providing a chamber with a wear-away portion that is recessed within the cutting end;

(b) providing a restrictor in fluid communication with the chamber and the drilling fluid passageway and slidably carried within the drilling fluid passageway;

(c) during operation, causing the wear-away portion to wear away and expose the chamber to a wellbore pressure; then (d) causing the restrictor to slide along an inner wall surface of the drilling fluid passageway from a first position to a second position in response to the wellbore pressure, the second position defined by a portion of the restrictor sliding alone the inner wall surface of the drilling fluid passageway to at least partially restricting the flow of drilling fluid through the drilling fluid passageway to cause an increase in the drilling fluid pressure.

19. The method of claim 18, wherein step (b) comprises applying drilling fluid pressure to a first pressure area of the restrictor; and step (d) comprises applying wellbore pressure to a second pressure area of the restrictor, the second pressure area being greater than the first pressure area.

20. The method of claim 18, wherein step (d) comprises moving the restrictor to a position at least partially blocking passage of drilling fluid from the drilling fluid passageway through the outlet.

21. A method of indicating wear of a downhole abrading tool having a body for connection to a drill string and having a drilling fluid passageway therethrough having an outlet for the passage of a drilling fluid having a drilling fluid pressure, and a cutting end on the body for rotation against an object in the well, the method comprising the steps of:

(a) providing a chamber with a wear-away portion that is recessed within the cutting end;

(b) providing a restrictor in fluid communication with the chamber and the drilling fluid passageway and applying drilling fluid pressure to a first pressure area of the restrictor;

(c) during operation, causing the wear-away portion to wear away and expose the chamber to a wellbore pressure; then (d) applying wellbore pressure to a second pressure area of the restrictor, the second pressure area being greater than the first pressure area, causing the restrictor to move in response to the wellbore pressure to a position at least partially restricting the flow of drilling fluid through the drilling fluid passageway to cause an increase in the drilling fluid pressure.

22. The method of claim 21, wherein the restrictor is slidably carried within the drilling fluid passageway, and step (d) comprises moving the restrictor to a position at least partially blocking passage of drilling fluid from the drilling fluid passageway through the outlet.

23. A downhole abrading tool for rotatably abrading an object in a well, the downhole abrading tool comprising:

a body for connection to a drill string and having a drilling fluid passageway therethrough with an outlet for the passage of a drilling fluid having a drilling fluid pressure;

a cutting end on the body for rotation against an object in the well;

a chamber having a wear-away portion that is recessed within the cutting end, the wear-away portion wearing away and exposing the chamber to a wellbore pressure when the cutting end wears a selected amount; and a movable restrictor in fluid communication with the chamber and the drilling fluid passageway, for movement from a first position to a second position, creating a pressure increase in the drilling fluid passageway when the chamber is exposed to the wellbore pressure, wherein the restrictor comprises a piston having a first pressure area in fluid communication with the chamber, and a second pressure area in fluid communication with the drilling fluid passageway, the first pressure area being greater than the second pressure area.

24. A downhole abrading tool for rotatably abrading an object in a well, the downhole abrading tool comprising:

a body for connection to a drill string and having a drilling fluid passageway therethrough with an outlet for the passage of a drilling fluid having a drilling fluid pressure;

a cutting end on the body for rotation against an object in the well;

a chamber having a wear-away portion that is recessed within the cutting end, the wear-away portion wearing away and exposing the chamber to a wellbore pressure when the cutting end wears a selected amount; and a movable restrictor in fluid communication with the chamber and the drilling fluid passageway, for movement from a first position to a second position, creating a pressure increase in the drilling fluid passageway when the chamber is exposed to the wellbore pressure, wherein the outlet intersects the drilling fluid passageway at a port and while in the first position, the restrictor is spaced below the port in the drilling fluid passageway and in the second position the restrictor at least partially blocks the port.

25. The downhole abrading tool of claim 24, wherein the restrictor comprises:

a movable piston that moves axially when the wear-away portion wears away and the chamber is exposed to the wellbore pressure, the movable piston having a closed first side exposed to an atmospheric pressure in the chamber and a bore containing a fixed piston, the bore defining an annular second side exposed to the drilling fluid pressure in the drilling fluid passageway, so that when the first side is exposed to wellbore pressure via the chamber, the movable piston slides upward relative to the fixed piston to the second position.

26. The downhole abrading tool of claim 25, wherein the downhole tool further comprises a rod extending downward from the fixed piston sealingly through closed first side of movable piston, the rod being stationary carried by the body.

27. The downhole abrading tool of claim 25, wherein the fixed piston limits movement of the movable piston to the second position.

* * * * *